US008245772B1

(12) United States Patent
Pruitt et al.

(10) Patent No.: US 8,245,772 B1
(45) Date of Patent: Aug. 21, 2012

(54) EXTENDED WEAR BALL LOCK FOR ROTATING HEAD

(75) Inventors: Grant Pruitt, Fort Smith, AR (US); Cris Braun, Leander, TX (US)

(73) Assignee: Pruitt Tool & Supply Co., Fort Smith, AR (US)

( * ) Notice: Subject to any disclaimer, the term of this patent is extended or adjusted under 35 U.S.C. 154(b) by 0 days.

(21) Appl. No.: 12/930,730

(22) Filed: Jan. 14, 2011

Related U.S. Application Data

(63) Continuation of application No. 12/074,151, filed on Feb. 29, 2008, now Pat. No. 7,870,896.

(51) Int. Cl.
*E21B 19/00* (2006.01)

(52) U.S. Cl. ..... 166/84.3; 166/83.1; 277/326; 277/343

(58) Field of Classification Search ..... 166/237, 166/84.3, 86.1, 83.1; 175/320, 325.1, 325.2, 175/209; 285/33, 268, 922; 277/326, 343
See application file for complete search history.

(56) References Cited

U.S. PATENT DOCUMENTS

| | | | | |
|---|---|---|---|---|
| 1,157,644 | A | 10/1915 | London | |
| 2,885,583 | A * | 5/1959 | Zunick et al. | 378/132 |
| 3,061,387 | A | 10/1962 | Laws | 308/187 |
| 3,400,938 | A | 9/1968 | Williams | 277/31 |
| 3,992,019 | A | 11/1976 | Crawshay | 279/4 |
| 4,029,368 | A | 6/1977 | Tschirky et al. | |
| 4,037,890 | A | 7/1977 | Kurita et al. | 308/187 |
| 4,138,148 | A | 2/1979 | Zaremba | 285/317 |
| 4,185,856 | A | 1/1980 | McCaskill | 285/18 |
| 4,466,551 | A | 8/1984 | Leung | 220/293 |
| 4,511,193 | A | 4/1985 | Geczy | 384/611 |
| 4,531,766 | A | 7/1985 | Crase | 285/18 |
| 4,620,730 | A | 11/1986 | Larsen | 285/166 |
| 4,856,827 | A | 8/1989 | Delamare | 285/268 |
| 5,028,181 | A | 7/1991 | Jenkins et al. | 409/215 |
| 5,180,261 | A | 1/1993 | Schreiber | 408/239 |
| 5,482,331 | A | 1/1996 | Shore | 285/314 |
| 5,647,444 | A * | 7/1997 | Williams | 175/209 |
| 5,662,181 | A | 9/1997 | Williams et al. | 175/195 |
| 6,033,117 | A | 3/2000 | Cariveau et al. | 384/94 |
| 6,457,749 | B1 | 10/2002 | Heijnen | 285/307 |
| 6,929,076 | B2 | 8/2005 | Fanuel et al. | 175/267 |
| 7,004,266 | B2 | 2/2006 | Russell et al. | 175/321 |
| 7,152,509 | B2 | 12/2006 | McCalley, Jr. et al. | 81/53.2 |
| 7,870,896 | B1 * | 1/2011 | Pruitt et al. | 166/84.3 |
| 2004/0250766 | A1 | 12/2004 | Fink | 118/715 |
| 2005/0252692 | A1 | 11/2005 | Liu et al. | 175/376 |
| 2006/0049587 | A1 | 3/2006 | Cornwell | 279/75 |
| 2007/0151725 | A1 * | 7/2007 | Cook et al. | 166/208 |

* cited by examiner

*Primary Examiner* — Daniel P Stephenson
*Assistant Examiner* — Yong-Suk Ro
(74) *Attorney, Agent, or Firm* — Keisling & Pieper PLC; Stephen D. Schrantz

(57) ABSTRACT

An improved rotating head that utilizes a box assembly that stores at least one locking element that allows for movement of the locking balls within the box assembly such that a liner inserted into the box assembly biases the locking elements to a locked position to couple the box assembly and the outer barrel. An integrated wear surface of the present invention seals the bearing elements to extend the life of the rotating head and reduce downtime caused by necessary maintenance of the rotating head.

20 Claims, 10 Drawing Sheets

EXTENDED WEAR BALL LOCK FOR ROTATING HEAD

CROSS-REFERENCE TO RELATED APPLICATIONS

This application claims priority to and is a continuation of U.S. patent application Ser. No. 12/074,151 filed on Feb. 29, 2008 now U.S. Pat. No. 7,870,896 entitled EXTENDED WEAR BALL LOCK FOR ROTATING HEAD.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

In well drilling, with a rotary drilling rig, the drill bit and drilling pipe receive rotary motion from power equipment located on the surface. Below the drilling floor, at the ground surface, there is usually an assembly known as a rotating head that provides means for the circulation of various fluids used in the drilling. The present invention relates to rotating heads for oil and gas wells and more particularly, to an improved rotating head that enables the ease of use for the end user and also a more efficient method of assembly and disassembly to decrease down time caused by assembling or disassembling the rotating head and to decrease manufacturing costs. A conventional drilling string is inserted or "stabbed" through the rotating head assembly, including the one or two base stripper rubber units rotatably mounted in the rotating head assembly, to seal the drilling string.

In well drilling, with a rotary drilling rig, the drill bit and drilling pipe receive rotary motion from power equipment located on the surface. Below the drilling floor, at the ground surface, there is usually an assembly known as a rotating head that provides means for the circulation of various fluids used in the drilling.

U.S. Pat. No. 3,400,938, issued Sep. 10, 1960, discloses a rotating head assembly including means for assisting a circulation of lubricant around thrust bearings and sealing such bearings from well fluids and other debris. The circulation of lubricant around the bearings is assisted by providing annular recesses adjacent the bearings but is such as does not provide forced lubrication of the bearings.

The provision of forced circulation of lubricant for bearings journaling a shaft for rotation about a vertical axis is exemplified by U.S. Pat. No. 1,157,644, issued Oct. 19, 1915 and U.S. Pat. No. 4,037,890, issued Jul. 26, 1977. The former patent is provided with a bushing secured to the shaft for rotation therewith, which bushing has on its exterior surface spiral grooves which feed lubricant upwardly toward the bearing within which the shaft is journaled. The latter patent is directed to utilizing a spiral groove pump, also situated beneath the bearing, to pump lubricating oil downwardly into a lubricant reservoir extending upwardly to a point above the bearing whereby lubricating oil is caused to overflow downwardly into the bearing.

U.S. Pat. No. 3,061,387, issued Oct. 30, 1962, discloses a vertically disposed open ended tube rotatable with the shaft to cause lubricant to be continuously fed from a reservoir adjacent the lower end of the tube to the upper end of the tube whereby lubricant is fed continuously upwardly through the tube and when a critical speed is attained, the lubricant rises sufficiently high in the tube to be fed out from the top end to spray against the lower portion of an upper bearing, which oil then drains downwards toward and through a lower bearing as it returns by gravity to the reservoir.

Present day drilling operations are extremely expensive, and an effort to increase the overall efficiency of the drilling operation while minimizing expense requires the essentially continuous operation of the drilling rig. Thus, it is imperative that downtime be minimized.

In this regard, there is a need for improved sealing, lubricating, and cooling of bearings to maximize the useful life of the bearings. Seals for such bearings must effectively preclude the intrusion of well fluids or debris while at the same time ensuring retention of the bearing lubricant.

Primary features of the rotating head assembly of the present invention include an integrated seal surface on the inner barrel, a liner to seal the present invention, at least one metal encased spring loaded seal on each end of the inner barrel, a clamping mechanism, a box assembly and liner, and die spring loaded bearings. The box assembly can be utilized to facilitate rapid assembly and disassembly of the rotating head assembly.

Another primary feature is mounting of the two metal encased spring loaded seals on each end of the inner barrel. The seals on the lower end will be arranged in a manner that will allow a continuous pressurized flush of the internal cavity of bearing assembly. The two seals on the top side of inner barrel will be arranged in a manner that will allow circulation for constant supply of lubrication from multiple inlet ports.

Known art may be found in U.S. Class 175, Subclasses 320, 325.1, 325.2, and 325.5 and U.S. Class 285, Subclasses 33, 268, 922, and other relevant areas.

2. Description of the Known Art

Among the patents which relate to rotating head assemblies are the following:

U.S. Pat. No. 3,992,019 (the '019 patent) issued to Crawshay on Nov. 16, 1976 discloses a core sampling drill head having powered drill chuck with jaws to grip drill rod. Head has thrust member movable by chuck actuating means between jaws retracted and jaws extended position, and precompressed chuck springs cooperating with thrust member and drill chuck so as to be movable with thrust member. Thrust member is located by releasable locking means in desired position, which means also relieve drill bearings of reaction from chuck springs. When thrust member is in jaws retracted position, chuck springs are precompressed by tension means and relatively large diameter tools can pass drill chuck. When thrust member is in jaws extended position, chuck springs cooperate with chuck, are further compressed and extend jaws to grip rod, and tension means are relieved of load from chuck springs. By recompressing and moving springs by themselves, worn drill rods can be accommodated in relatively short drill head without loss of grip. Also, with hydraulically controlled chuck actuating means, when chuck jaws are gripping rod loss of hydraulic fluid pressure does not result in loss of grip on rod as chuck springs are independent of fluid pressure.

U.S. Pat. No. 4,511,193 (the '193 patent) issued to Geczy on Apr. 16, 1985 teaches a combined radial and thrust bearing assembly for a down-hole drilling assembly to journal a shaft, mounting the drill bit, in a housing. The bearing assembly is used between a down-hole fluid powered-motor and a drill bit for drilling oil wells, for example. The bearing assembly includes cooperative pairs of upper and lower inner races located on the shaft for mutual rotation. Each of the inner races includes a pair of interchangeable toroidal tracks. Cooperative pairs of upper and lower outer races are fixed against rotation in the housing. Each outer race has a pair of interchangeable toroidal tracks to selectively cooperate with the tracks of the inner races to define a toroidal channel to receive a number of bearing balls. Spring means are disposed between the upper and lower pairs of outer races and the housing and between the upper and lower pairs of outer races to provide a compliant coupling for the even distribution of radial and upwardly and downwardly directed thrust loads between the races and balls and eventual transfer to the housing. Drilling fluid is circulated through the bearing assembly for cooling and lubrication.

U.S. Pat. No. 5,028,181 issued to Jenkins et al. on Jul. 2, 1991 discloses a quick change right angle drill head that incorporates mechanism rotating components within the drill head housing thereby resulting in a more compact package which facilitates use in space-limited locations. A single push button release enlarges a chuck opening to receive a cutting tool. An internally located compression spring becomes operative when reverse thrust forces are exerted against a cutting tool. The design of the present invention may be constructed to either lock the cutting tool into the drill head chuck or release it, upon exertion of the reverse thrust forces.

U.S. Pat. No. 5,180,261 issued to Schreiber on Jan. 19, 1993 discloses a motor-operated tool for tool sockets revolving about an axis, in particular for drills or spanners. The tool comprises a tool head containing a drive spindle. The drive spindle comprises a driving opening for a drive shank of the tool socket and a plurality of ball elements for engaging a part of the drive shank to lock it in the driving opening. The ball elements preferably are adapted to lock the drive shank in the driving opening automatically and to be released by a suitable mechanism. The tool socket is designed as a drill chuck and is provided with key elements for actuating the mechanism.

U.S. Pat. No. 5,647,444 issued to Williams on Jul. 15, 1997 discloses a rotating blowout preventor having at least two rotating stripper rubber seals which provide a continuous seal about a drilling string having drilling string components of varying diameter. A stationary bowl is designed to support a blowout preventor bearing assembly and receives a swivel ball that cooperates with the bowl to self-align the blowout preventor bearing assembly and the swivel ball with respect to the fixed bowl. Chilled water is circulated through the seal boxes of the blowout preventor bearing assembly and liquid such as water is pumped into the bearing assembly annulus between the stripper rubbers to offset well pressure on the stripper rubbers.

U.S. Pat. No. 6,457,749 issued to Heijnen on Oct. 1, 2002 discloses a lock assembly for locking an outer tubular element to an inner tubular element extending through the outer tubular element for holding loads between the tubular member when lowered downhole. The assembly includes a lock mandrel connected to one of the tubular elements and the other tubular element having a recess with at least one inwardly converging side surface. A lock member, having a retracted and an expanded mode, is arranged between the first and second tubular elements. The lock member is movable relative to the recess in the retracted mode and locks against the inwardly diverging side surface when in the expanded mode.

The known art teaches the use of threads and bolts for assembly of the rotating head. The use of bolts in the known art requires users to constantly monitor the bolts to ensure that the components of the rotating head are properly attached. Further, the use of bolts requires drilling personnel or other users to expend valuable time to both assemble and disassemble the rotating head thus leading to extended downtime of the rotating head.

SUMMARY OF THE INVENTION

The present invention relates to oil field equipment and specifically to a rotating head assembly having a stationary outer barrel with an inner barrel rotatably journaled therein and including a box assembly that provides for quick assembly and disassembly of the rotating head.

The box assembly stores locking elements that secure the box assembly to the outer barrel. The box assembly is a simplified and cost effective method of assembling a rotating head. The present invention utilizes a box assembly with locking elements that result in extreme strength while under pressure and eliminates complications caused by threads or lack of strength under pressure from bolts. One embodiment of the present invention provides a bolting system that allows a user an additional method to connect the box assembly.

The present invention further provides for an integrated seal surface on the inner barrel. By integrating the seal surface on the inner barrel, the present invention increases the lifespan of the seals and bearings by assisting the rotating head to run in a more concentric pattern. The use of the integrated seal surface on the inner barrel eliminates the problems associated with total indicated runout (TIR). The bearing elements are machined such that the bearing elements are indicated directly to the wear surface, which allows for the desired "zero TIR" that is crucial when managing pressure. By integrating the wear surface on the inner barrel, the present invention eliminates the assembly process of installing and uninstalling the wear surface via bolts, screws or any other known fasteners to attach the wear surface to the inner barrel.

Furthermore, the present invention utilizes a liner that adjusts the placement of the seals on the wear surface. As the seals wear the integrated wear surface of the inner barrel, a user can machine the seal cavity to relocate the seals to allow the new seals to be used in the same re-machined seal cavity. The newly relocated seals will now wear a new area of the same integrated wear surface of the inner barrel such that the present invention utilizes the entire wear surface of the inner barrel.

The present invention further provides two, metal encased spring loaded seals on each end of inner barrel. The seals on the lower end of the inner barrel are arranged to allow a continuous pressurized flush of the internal cavity of the bearings. The continuous flushing will result in a longer life of the bearings, seals, and other internal components. The two seals on the upper side of inner barrel are arranged to allow circulation for constant supply of lubrication from multiple inlet ports. The lubricant circulation system is configured to enhance the cooling of the seals whereby essentially round-the-clock operation may be maintained for months at a time without seal malfunction that would require a shutdown of the drilling operation.

Further, the present invention provides a clamping mechanism of a hydraulic cylinder with a back up bolt system that allows rig personnel to engage the clamp without being under the rig floor. Thus, the present invention provides a safer working environment for the rig personnel.

In addition, the present invention provides die spring loaded bearings that maintain an exact load on each bearing such that the bearings will be loaded according to the manufacturer's specifications. As the bearings wear, the springs will automatically adjust for any wear on the internal bearing cavity. The adjustment of the springs ensures that a constant load is maintained on the bearings such that a user is not required to constantly monitor the bearings to confirm proper loading of the bearings.

It is an object of the present invention to provide an improved rotating head that enables ease of use for the end user.

Another object of the present invention is to allow more efficient assembly and disassembly of the rotating head assembly.

Another object of the present invention is to increase efficiency of the assembly and disassembly of the rotating head assembly to decrease the amount of down time due to necessary repairs of the rotating head assembly.

Another object of the present invention is to adjust the location of the seals on the wear surface to increase the life of the seals.

Another object of the present invention is to increase the life of bearings, seals, and other internal components by allowing a continuous pressurized flush of the internal cavity of bearing assembly.

Another object of the present invention is to increase the life of bearings, seals, and other internal components by preventing debris from entering the bearings, seals, and other internal components.

Another object of the present invention is to allow for the trouble free operation of the rotating head assembly for the rig personnel.

Another object of the present invention is to allow circulation for a constant supply of lubrication from multiple inlet ports.

Another object of the present invention is to create a safer work environment for rig personnel.

Another object of the present invention is to simplify the method of assembly of the rotating head assembly.

Another object of the present invention is to maintain an exact load on each bearing that will meet the manufacturer's specifications.

Another object of the present invention is to allow a quick change rubber system that will save valuable time on the rig, thus eliminating time in which the rig is inoperable.

Another object of the present invention is to eliminate the problems arising from the use of threaded parts.

In addition to the features and advantages of the rotating head assembly according to the present invention, further advantages thereof will be apparent from the following description in conjunction with the appended drawings.

These and other objects of the invention will become more fully apparent as the description proceeds in the following specification and the attached drawings. These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
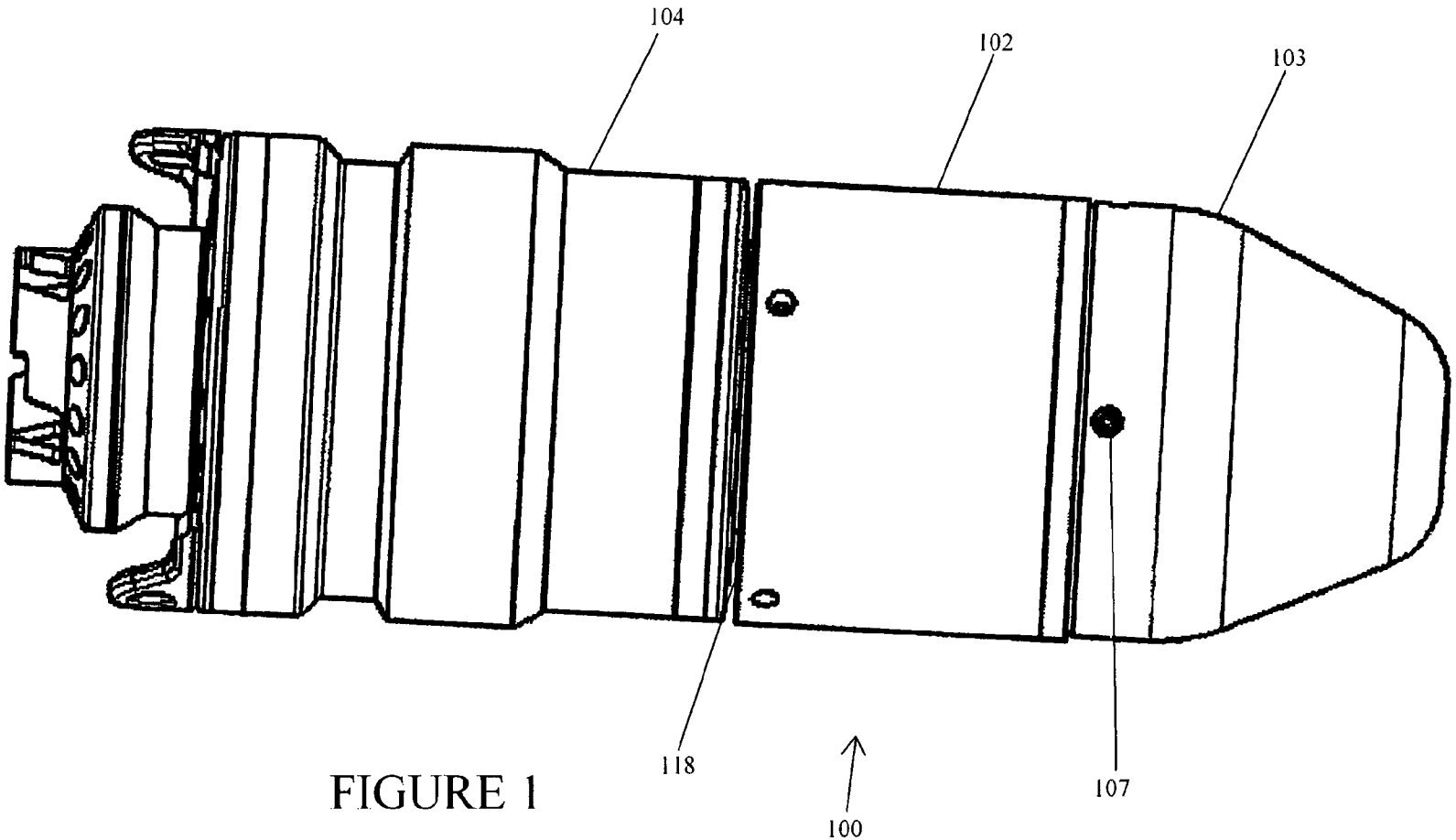
FIG. 1 is a front elevational view showing one embodiment of the present invention.

Referring to FIG. 1, the rotating head assembly of the present invention is generally illustrated by reference numeral 100. The rotating head assembly 100 is characterized by a bottom pot 102, an outer barrel 104, and a second rubber 103. Bottom pot 102 is releasably connected to inner barrel 118. As is shown in FIG. 1, bottom pot 102 is attached to second rubber 103 by the locking pin 107 of the rubber pot plate 192. Rubber pot plate 192 is securedly attached to bottom pot 102 by use of known fasteners such as threaded fasteners, including but not limited to bolts.

Figure 2:
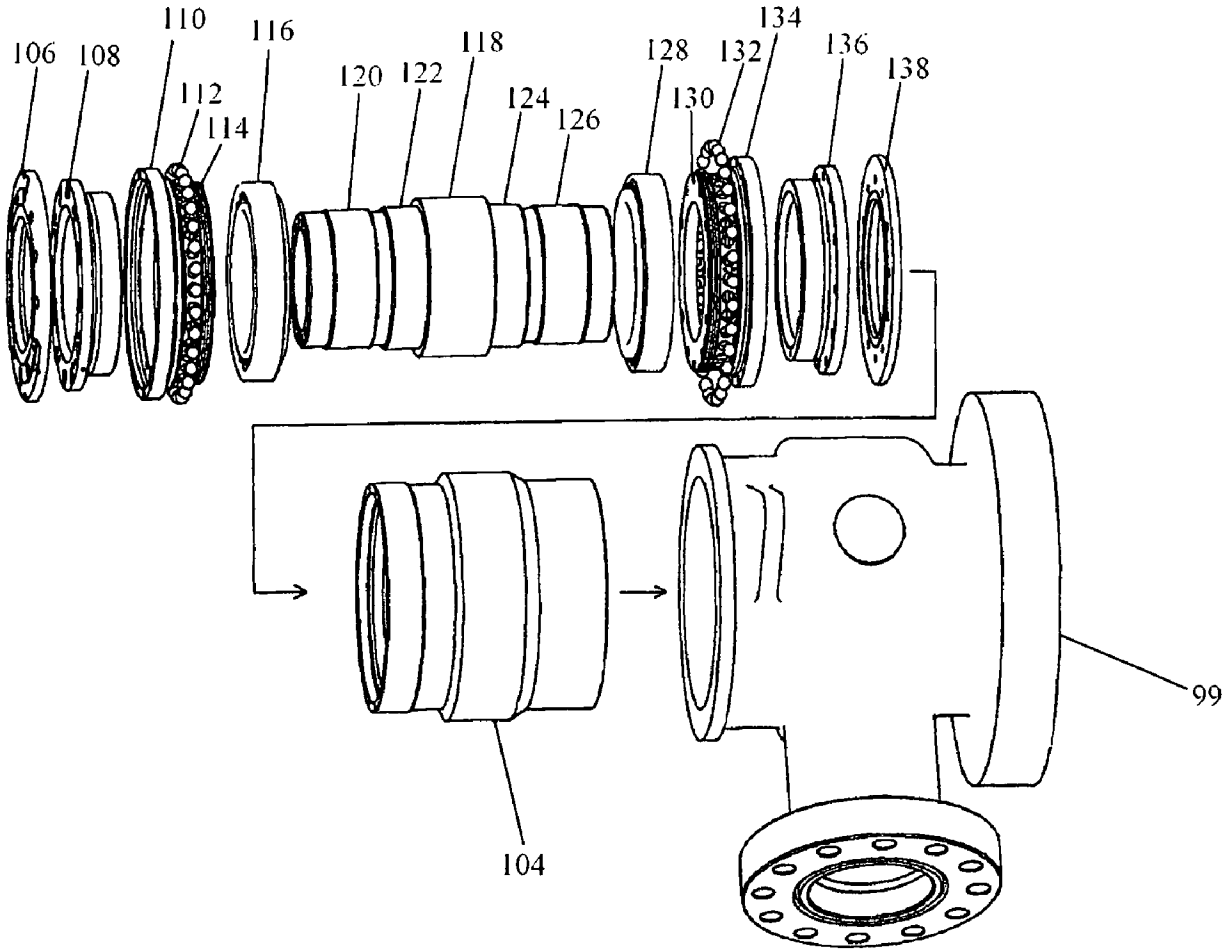
FIG. 2 is an exploded view of the present invention.
Figure 10:
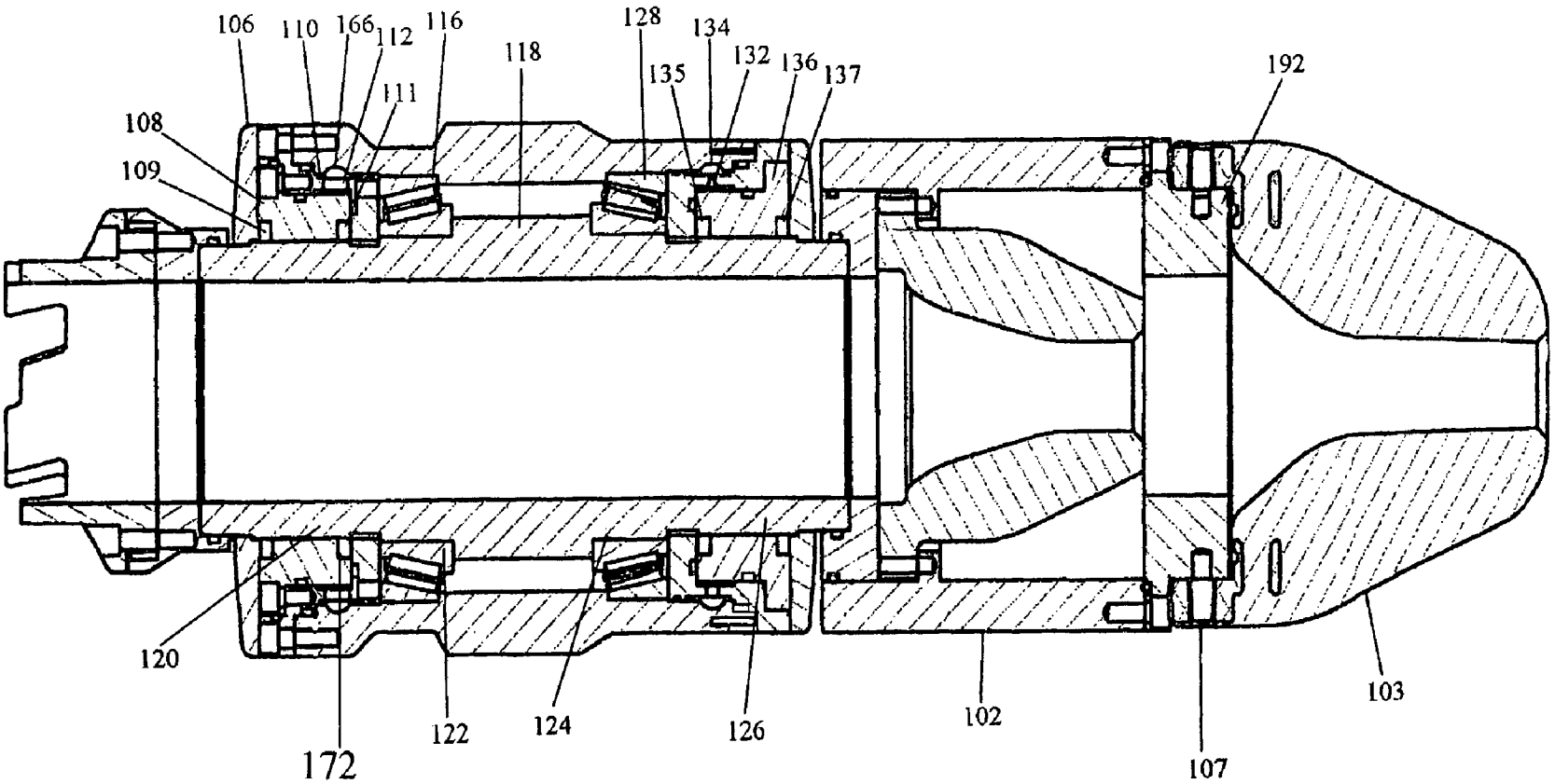
FIG. 10 is an internal view of one embodiment of the present invention.

FIG. 2 shows an exploded view of the rotating head assembly 100 and the rotatable attachment of inner barrel 118 to outer barrel 104. As seen in FIGS. 2 and 10, plates 106, 138 are releasably attached to liners 108, 136 by a fastener including but not limited to threaded fasteners or other known fasteners. Plates 106, 138 prevent debris and other contaminants from entering the rotating head assembly. In one embodiment of the present invention, plates 106, 138 are secured to outer barrel 104 by threaded fasteners or other known fasteners. The secured connection between plates 106, 138, liners 108, 136, and outer barrel 104 prevents debris from entering the bearing elements thus reducing unnecessary damage and downtime of the rotating head assembly.

As shown in FIGS. 2 and 10, liners 108 and 136 are inserted into box assemblies 110, 134 to seal the inner barrel 118 to protect the bearing elements 116, 128 from the outside environment. Referring to FIGS. 2 and 10, liners 108, 136 are inserted into box assemblies 110, 134 to bias locking elements 112, 132 to secure box assemblies 110, 134 to outer barrel 104 without the use of other known fasteners. By eliminating other types of fasteners, the locking elements 112, 132 reduce the time needed to assemble and disassemble the rotating head assembly. The locking elements 112, 132 of the present invention remove steps required for assembling known rotating heads. The insertion of liners 108, 136 into box assemblies 110, 134 biases locking elements 112, 132 to the locked position. Therefore, attaching inner barrel 118 to outer barrel 104 simply requires insertion of liners 108, 136.

The present invention also provides a secondary connection for attaching box assemblies 110, 134 to outer barrel 104. As a secondary attachment, the present invention provides fastening apertures of both box assemblies 110, 134 and outer barrel 104 for securing box assemblies 110, 134 to outer barrel 104 by threaded fasteners or other known fasteners. With the back-up secondary attachment system, the present invention also provides a more secure connection between outer barrel 104 and inner barrel 118.

Top plate 106 is securedly attached to liner 108, and box assembly 110. Top plate 106 covers the high pressure assembly to prevent debris and other contaminants from entering the rotating head assembly.

As shown in FIG. 2, box assemblies 110, 134 create a bearing assembly by releasably securing plate 106, liner 108, box 110, bearing element 116, plate 138, liner 136, box 134, and bearing element 128 to outer barrel 104 such that inner barrel 118 is mounted for rotation with respect to outer barrel 104. When liners 108, 136 are inserted into box assemblies 110, 134, locking elements 112, 132 engage a locking groove 166 found inside outer barrel 104. The locking elements 112, 132 securely connect box assemblies 110, 134 to outer barrel 104 without the use of bolts or other known fasteners. The box assemblies 110, 134 of the present invention allow a simplified method of assembling and disassembling the rotating head assembly 100. As a secondary connection, in one embodiment of the present invention, fasteners also secure box assemblies 110, 134 to outer barrel 104.

The present invention also reduces the amount of debris and other contaminants that enter the rotating head assembly. The contact between seals 109, 111, 135, 137 and wear surfaces 120; 126 prevent debris and other contaminants from entering bearing elements 114, 128. Furthermore, the present invention utilizes liners 108, 136 with a seal cavity 172 that adjusts the placement of the seals 109, 111, 135, 137 on the wear surfaces 120, 126. The seals 109, 111, 135, 137 contact wear surfaces 120, 126 to seal and reduce damage to bearing elements 116, 128. Inner barrel 118 rotates in relation to both liners 108, 136 and the seals 109, 111, 135, 137 located within the seal cavities 172 of liners 108, 136. Therefore, as inner barrel 118 rotates in relation to seals 109, 111, 135, 137, wear surfaces 120, 126 erode at the contact point of the seals 109, 111, 135, 137 and wear surfaces 120, 126 during drilling operations.

Over a period of use, wear surfaces 120, 126 deteriorate such that the bearing elements 114, 128 are not properly enclosed. As seal surfaces wear, the internal pressure of the rotating head will escape. To prevent damage to bearing elements 114, 128, seal cavities 172 of liners 108, 136 are re-machined to adjust the location of the seals 109, 111, 135, 137 to an unused portion of wear surfaces 120, 126. Because liners 108, 136 do not vertically move in relation to inner barrel 118 and wear surfaces 120, 126, the seals 109, 111, 135, 137 erode a concentric ring around wear surfaces 120, 126. After wear surfaces 120, 126 have eroded such that the seals 109, 111, 135, 137 no longer properly protect bearing elements 116, 128, the present invention allows re-machining of the seal cavities 172 of liners 108, 136 to vertically displace the seals 109, 111, 135, 137. The vertically displaced seals 109, 111, 135, 137 now contact an unused area of wear surfaces 120, 126. Because the wear surfaces 120, 126 erode in a concentric manner, the seals 109, 111, 135, 137 will not contact the deteriorated areas of wear surfaces 120, 126 during rotation of inner barrel 118 in relation to outer barrel 104. By adjusting the location of the seals 109, 111, 135, 137 to an unused portion of wear surfaces 120, 126, seals 109, 111, 135, 137 and wear surfaces 120, 126 properly enclose bearing elements 114, 128. Thus, the adjusted seals 109, 111, 135, 137 prevent unnecessary damage to the rotating head assembly. The newly relocated seals 109, 111, 135, 137 will now wear an unused area of the same integrated wear surfaces 120, 126 of the inner barrel 118 such that the present invention utilizes the entire wear surfaces 120, 126 of the inner barrel 118.

Seals 109, 111, 135, 137 maintain pressure within the rotating head assembly and prevent well bore pressure from entering the rotating head assembly. Hydraulic fluid within the rotating head assembly maintains the pressure in the rotating head assembly. In addition, the hydraulic fluid found within the rotating head assembly lubricates the bearing elements 116, 128. Metal encased spring loaded seals 109, 111, 135, 137 are mounted on wear surfaces 120, 126 of inner barrel 118. The seals 135, 137 contacting wear surface 126 are arranged in a manner that will allow a continuous pressurized flush of the internal cavity of the bearing assembly. The continuous flushing will result in a longer life of the bearings, seals, and other internal components. The two seals 109, 111 contacting wear surface 120 are arranged in a manner that will allow circulation for constant supply of lubrication from multiple inlet ports. The lubricant circulation system is configured to enhance the cooling of the seals 109, 111, 135, 137 whereby essentially round-the-clock operation may be maintained for months at a time without seal malfunction that would require a shutdown of the drilling operation.

Figure 3:
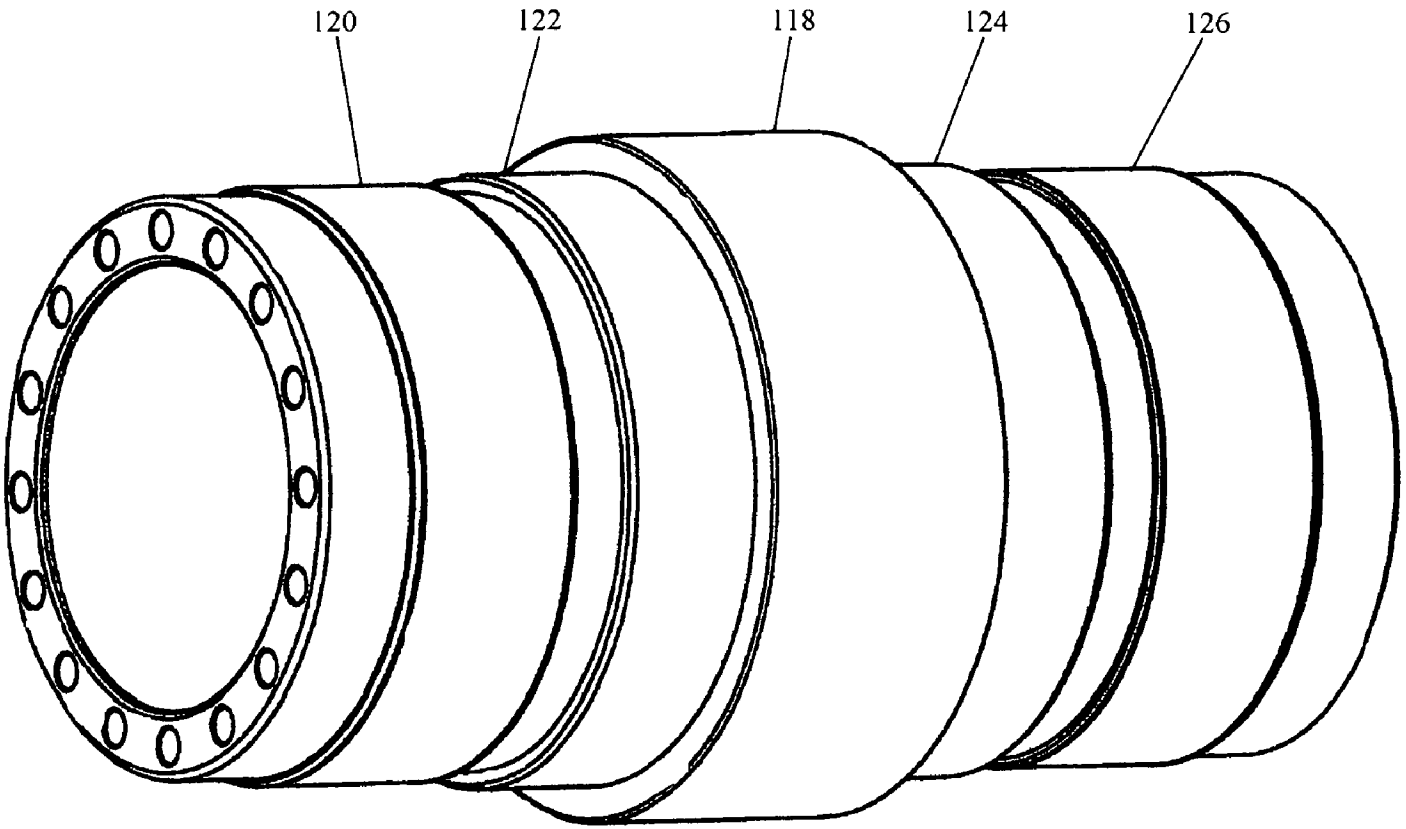
FIG. 3 is a perspective view of the inner barrel of the present invention.

FIG. 3 shows the integrated wear surfaces 120, 126 of the inner barrel 118. In one embodiment of the present invention, wear surfaces 120, 126 are constructed of tungsten. The present invention provides for two integrated wear surfaces 120, 126 on the inner barrel 118. By integrating the wear surfaces 120, 126 on the inner barrel 118, the present invention increases the lifespan of the seals 109, 111, 135, 137 and bearing elements 116, 128 by assisting the rotating head to run in a more concentric pattern. The use of the integrated wear surfaces 120, 126 on the inner barrel 118 eliminates the problems associated with total indicated runout (TIR). The bearing elements 116, 128 are machined such that the bearing elements 116, 128 are indicated directly to the wear surfaces 120, 126, which allows for the desired "zero TIR" that is crucial when managing pressure. By integrating the wear surfaces 120, 126 on the inner barrel 118, the present invention eliminates the assembly process of installing and uninstalling the wear surfaces 120, 126 via bolts, screws or any other known fasteners to attach the wear surfaces 120, 126 to the inner barrel 118.

The increased surface area of wear surfaces 120, 126 not only extends the lifespan of the bearing elements 114, 128, but also reduces the amount of maintenance needed to properly enclose bearing elements 114, 128. The adjustable seal cavities of the present invention allows users of the present invention to properly seal the bearing elements 114, 128 without the complete disassembly of the rotating head assembly. Thus, the present invention eliminates the maintenance work required to properly seal bearing elements 114, 128. Instead, a user of the present invention simply removes liners 108, 136 to adjust the seal cavities to a new wear area of wear surfaces 120, 126. The user then reinstalls the liners 108, 136 with the adjusted seal cavities and continues drilling operation. Further, by maximizing the usable area of wear surfaces 120, 126, the present invention reduces down time and costs of the rotating head assembly by eliminating the steps required to access the wear surface, remove the wear surface, and install a new wear surface. The adjustable seal cavities also reduce costs associated with the wear surfaces 120, 126. The present invention maximizes the usable surface area of wear surfaces 120, 126 thus decreasing the number of replacement wear surfaces 120, 126 required for the drilling operation.

Inner barrel 118 also provides bearing surfaces 122, 124. Bearing elements 116, 128 contact inner barrel 118 at bearing surfaces 122, 124. The bearing elements 116, 128 allow inner barrel 118 to rotate with respect to outer barrel 104.

Figure 4:
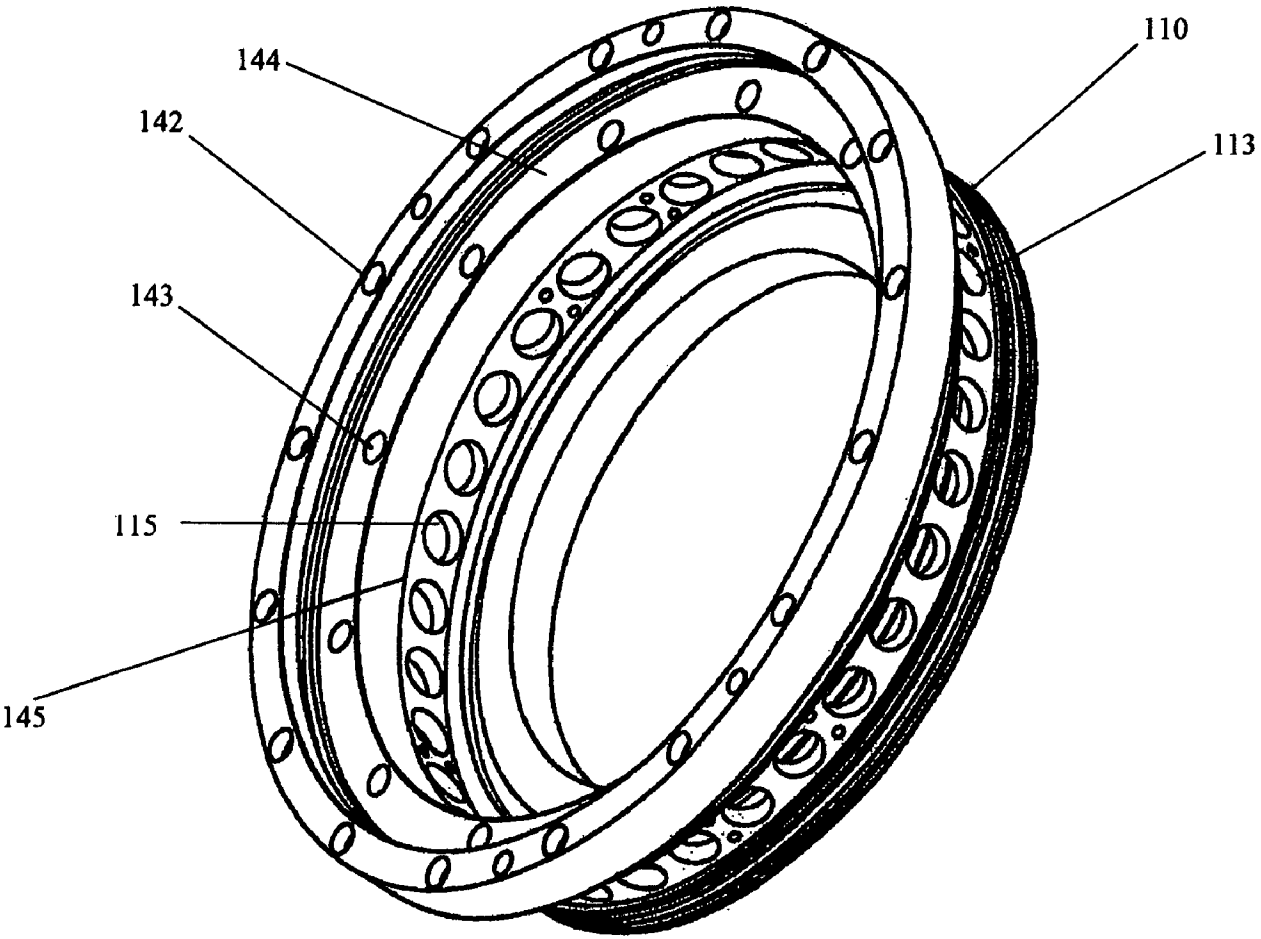
FIG. 4 is a perspective view of the box of the present invention.

As shown in FIG. 4, box assembly 110 loads the bearing elements 116, 128. Further, box assembly 110 retains the components of the present invention to prevent disassembly of the components of the present invention. Locking elements 112, 132 attach the box apertures 110, 134 to the outer barrel 104. A user of the present invention inserts liners 108, 136 into box apertures 110, 134 respectively to bias the locking elements 112, 132 stored within locking storage 115 into a lock position. The liners 108, 136 prevent the locking elements 112, 132 from adjusting to the unlock position. When liners 108, 136 are removed from box assemblies 110, 134, the locking elements 112, 132 are no longer biased to a lock position. Instead, the locking elements can freely adjust from the locked position to the unlocked position thus allowing box assemblies 108, 134 to be removed from outer barrel 104. In one embodiment of the present invention, locking elements 112, 132 are locking balls stored within locking apertures 113. In one embodiment of the present invention, locking apertures 113 are center punched to allow insertion of a locking ball 132. After the locking ball 112, 132 is inserted into ball aperture 113, the locking apertures 113 are center punched a second time thus securing the locking elements 112, 132 in locking apertures 113 such that locking elements 112, 132 can move within locking apertures 113 even though the locking balls 132 can not be easily removed from locking apertures 113. In another embodiment of the present invention, a ball enclosure is attached adjacent to the locking apertures 113. The ball enclosure surrounds all of the locking apertures 113. The ball enclosure prevents locking elements 112, 132 from exiting locking apertures 113.

In one embodiment of the present invention, threaded hole 143 of box assembly 110 allows liner 108 to be releasably attached to box assembly 110. To releasably attach liner 108 to box assembly 110, liner 108 is fastened to box assembly 110 through fastening aperture 150. Liner 108 may be releasably attached to box assembly 110 by other methods known in the art. In another embodiment, liner 108 is not releasably attached to box assembly 110. Instead, liner 108 is simply inserted into box assembly 110. Box assembly 134 may be releasably attached to liner 136 by the same methods as box assembly 110 is attached to liner 108. As a secondary connection system, secondary attachment aperture 142 of box 134 accepts a fastener, such as a bolt, to attach box assembly 110 to outer barrel 104.

Figure 5:
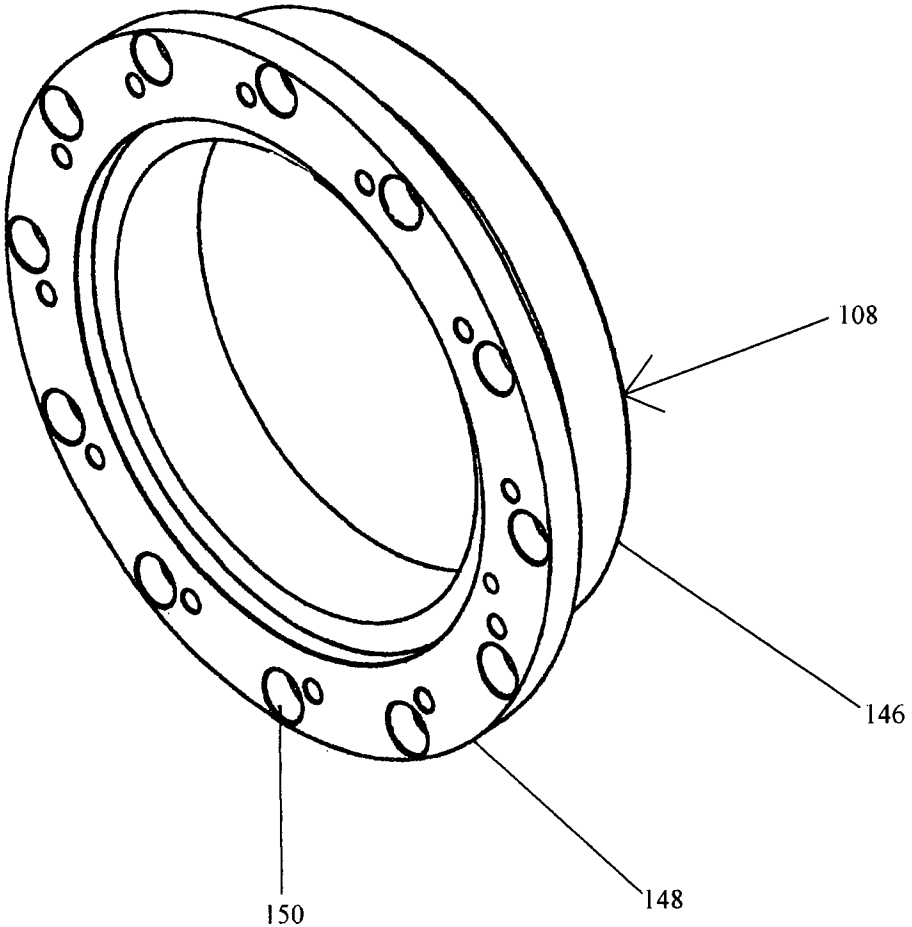
FIG. 5 is a perspective view of the liner of the present invention.

Referring to FIG. 5, liner 108 is simply inserted into box assembly 110 such that liner neck 146 is inserted into box assembly 110. Liner shoulder 148 of liner 108 engages liner lip 144 of box assembly 110 to secure liner 108 to box assembly 110. Liner neck 146 of liner 108 is of a diameter slightly smaller than locking ball ring 145 such that liner 108 can be inserted into box assembly 110. When liner 108 is inserted into box assembly 110, liner neck 146 biases locking balls 112 from an unlocked position to a locked position in locking apertures 113.

To remove the box assembly 110 from outer barrel 104, a user removes liner 108 from box assembly 110. Liner neck 146 no longer biases locking elements 112 into a locked position. Because locking elements 112 are no longer biased to the locked position, the locking elements 112 are free to adjust from a locked position to an unlocked position within locking apertures 113. Because locking elements 112 are free to move within locking apertures 113 when liner 108 is removed, the locking elements 112 can be adjusted from a locked position to an unlocked position such that the box assembly 110 can be removed from liner 108.

Figure 6:
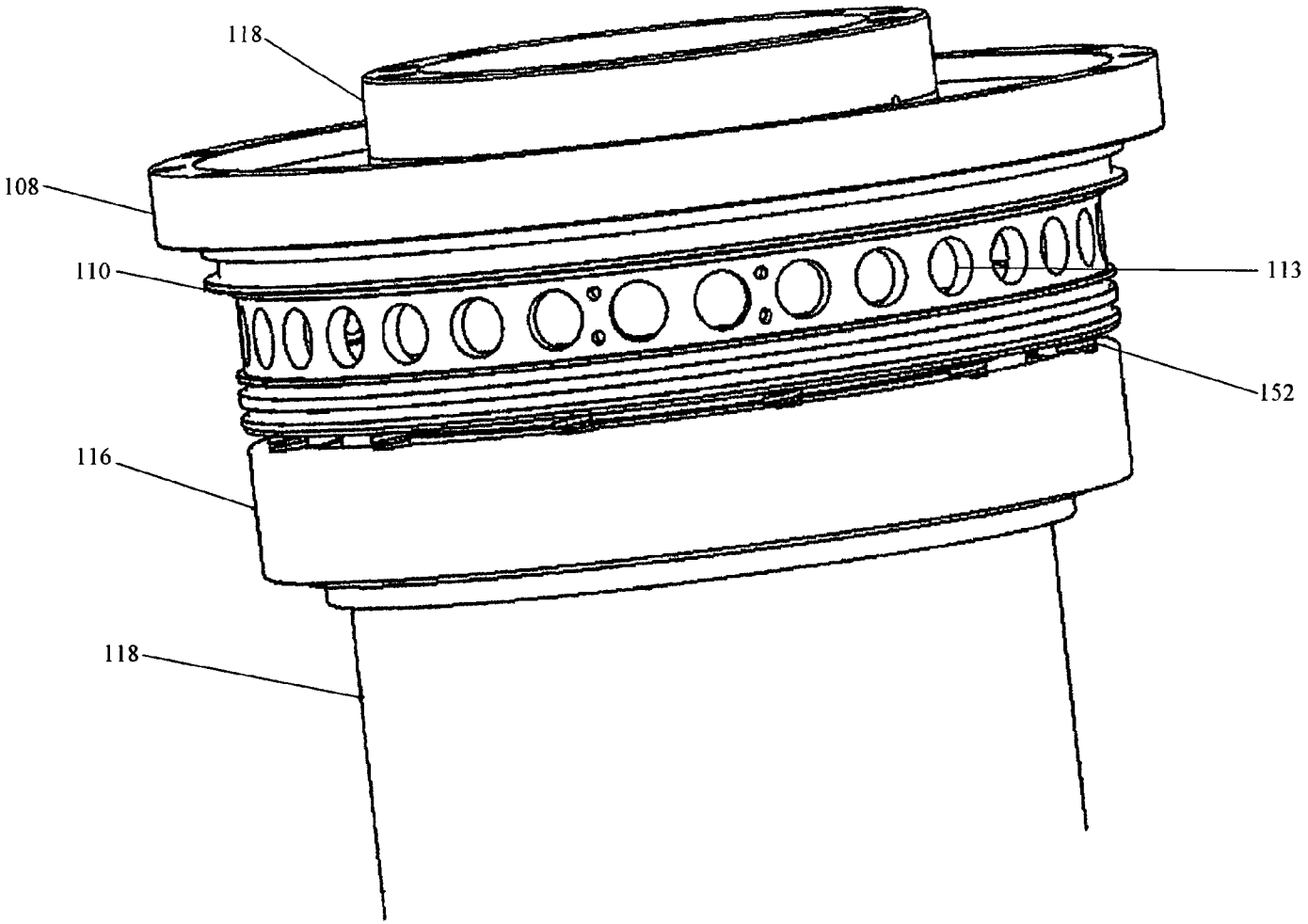
FIG. 6 is a partial view of the a portion of present invention.

As shown in FIG. 6, box assemblies 110, 134 are placed adjacent to bearing elements 116, 128. Because installation of liners 108, 136 attaches box assemblies 110, 134 to outer barrel 104, the box assemblies 110, 134 are installed such that the box assemblies 110, 134 load bearing elements 116, 128. Bearing elements 116, 128 allow inner barrel 118 to rotate in relation to outer barrel 104. In one embodiment, box assemblies 110, 134 contain die springs 152 that load bearing elements 116, 128 pursuant to the manufacturer's specifications.

As shown in FIG. 6, liners 108, 136 are inserted into box assemblies 110, 134. Die springs 152 located within spring apertures 128 of box assemblies 110, 134 create a constant load of bearing elements 116, 128. The die springs 152 are arranged within box assemblies 110, 134 to load bearing elements 116, 128 according to the manufacturer's specifications. The constant load of bearing elements 116, 128 reduces the down time caused by unsatisfactory bearing elements. Further, the constant load of bearing elements 116, 128 reduces unnecessary damage to bearing elements 116, 128. Such a constant load of bearing elements 116, 128 reduces costs of replacing bearing elements 116, 128 and increases the operating time of the drilling rig.

Die springs 152 maintain a constant load on bearing elements 116, 128. By maintaining a constant load, the present invention can better maintain the manufacturer's recommended load on bearings 116, 128. One embodiment of the present invention provides box assemblies 110, 134 loaded with to the manufacturer's specifications such that the present invention does not require special equipment required to measure the load exerted on the bearings. The box assemblies 110, 134 of the present invention are loaded with the number and type of die springs specified by the manufacturer of the bearings. Therefore, the number and type of die springs utilized in the present invention depends upon the manufacturer's specifications for loading the bearing elements. Further, as the internal bearing cavity wears, the die springs 152 of the present invention adjust for the wear of the internal cavity such that the load on the bearings will remain constant over use. By maintaining a constant load on the bearings, the present invention extends the life of the rotating drill head and allows for trouble free operation for rig personnel.

Figure 7:
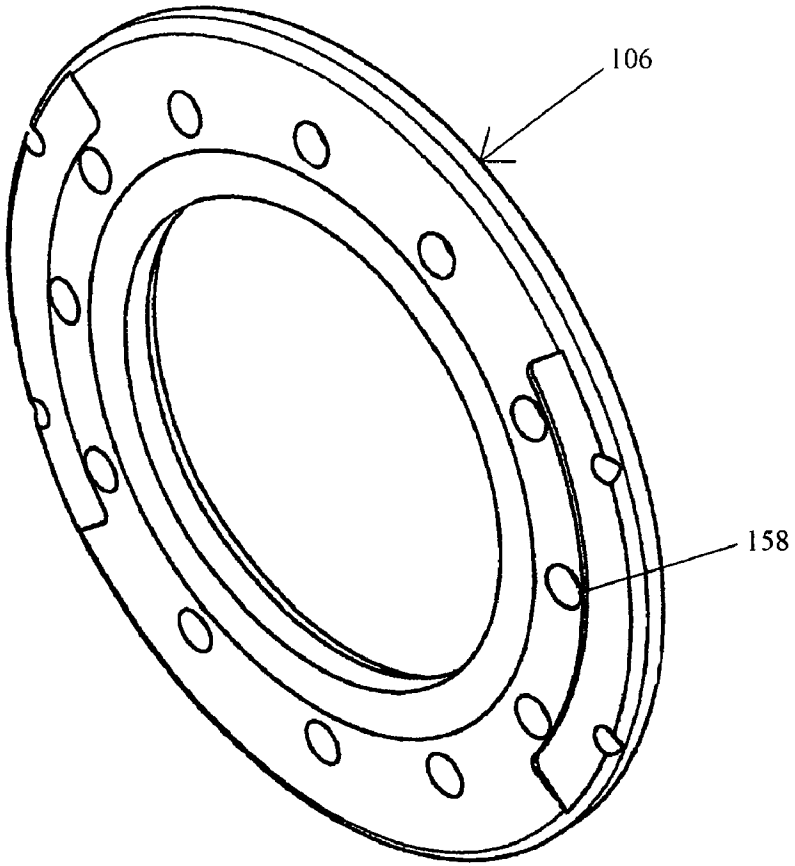
FIG. 7 is a perspective view of the top plate of the present invention.

FIG. 7 shows the top plate 106 of the present invention. The top plate 106 covers the high pressure assembly to prevent debris and other contaminants from entering the rotating head assembly. In one embodiment of the present invention, top plate 106, liner 108, and box assembly 110 are removably attached through fastening aperture 158. In one embodiment, fastening aperture 158 is a threaded bolt hole.

Figure 8:
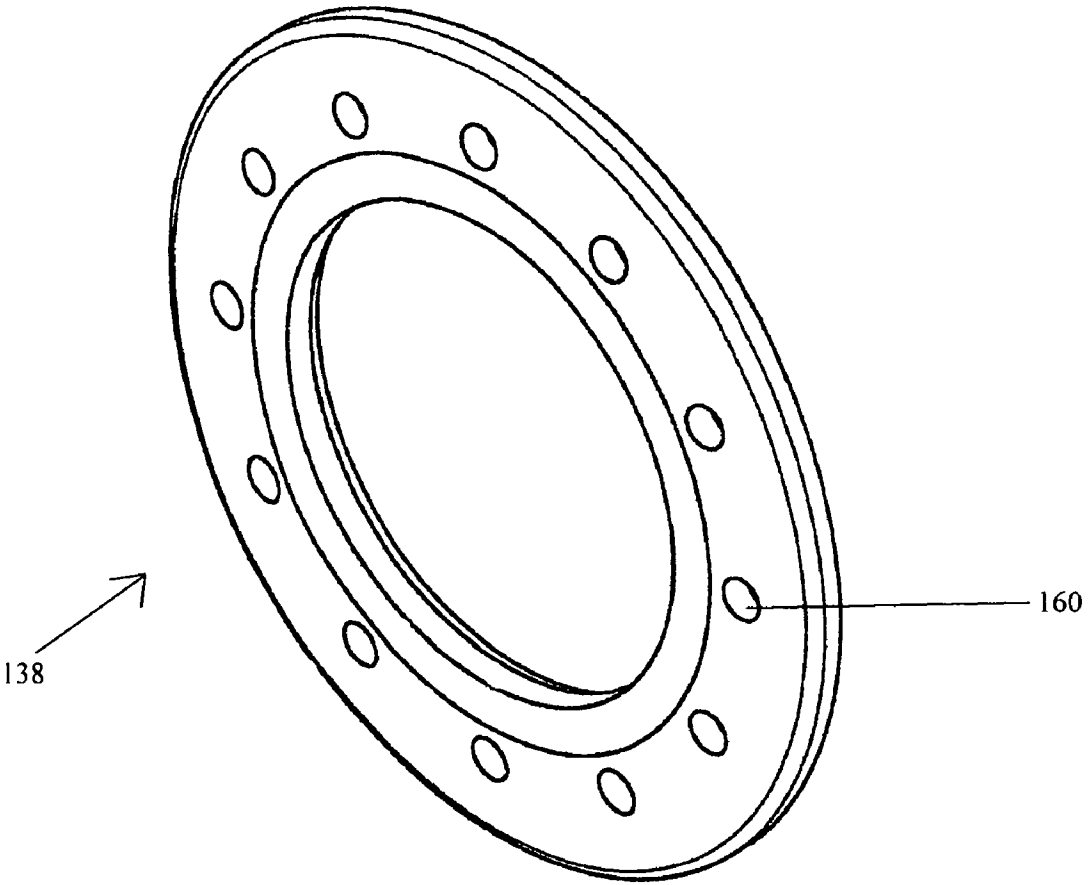
FIG. 8 is a perspective view of the bottom plate of the present invention.

FIG. 8 shows the bottom plate 138 of the present invention. The bottom plate 138 of the present invention prevents debris and other contaminants from entering the rotating head assembly. In one embodiment of the present invention, bottom plate 138, liner 136, and box assembly 134 are removably attached through fastening aperture 160. In one embodiment, fastening aperture 158 is a threaded bolt hole.

Figure 9:
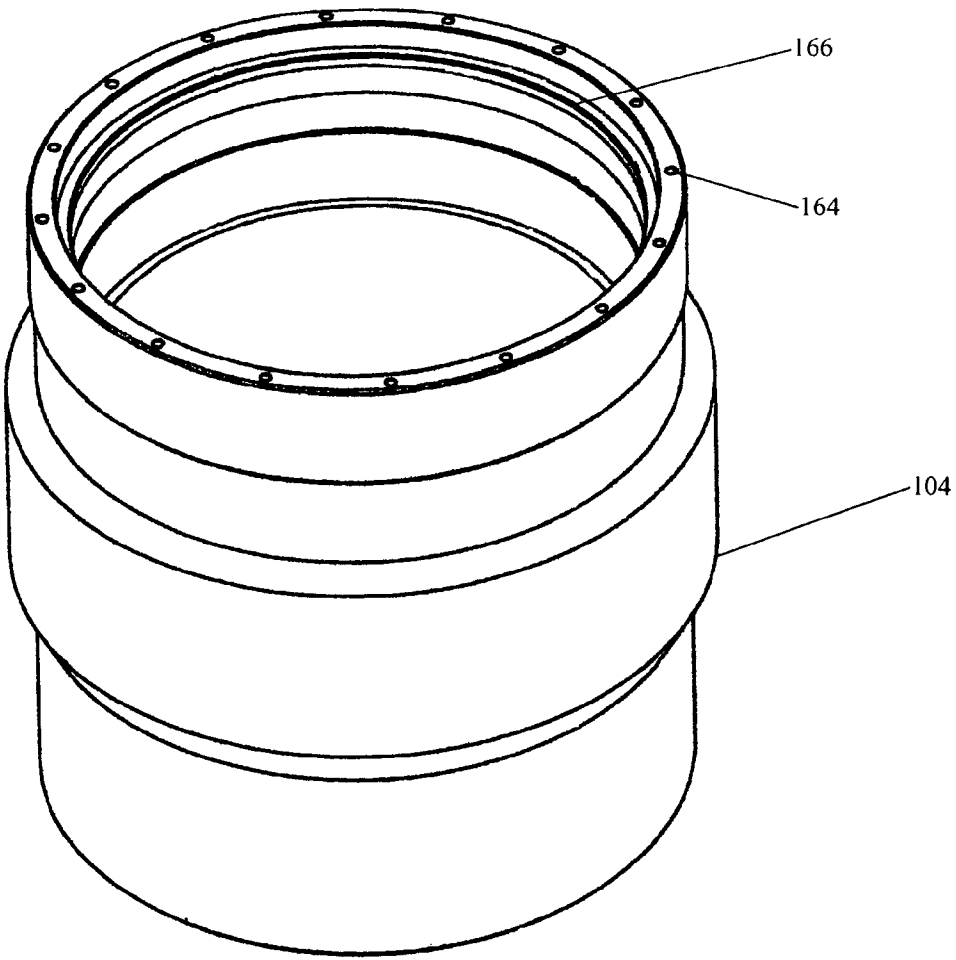
FIG. 9 is a perspective view of the outer barrel of the present invention.

The outer barrel 104 of the present invention is shown in FIG. 9. Bolt holes 164 secure outer barrel 104 to box assemblies 110, 134. Outer barrel 104 is mounted into bowl 99 as shown in FIG. 2. Furthermore, outer barrel 104 provides a ball locking groove 166 that provides a reception area for the locking elements 112, 132 of the box assemblies 110, 134 on each end of outer-barrel 104. The ball locking groove 166 allows the locking elements 112, 132 to be biased by liners 108, 136 such that the locking elements 112, 132 securely attach box assemblies 110, 134 to outer barrel 104. While liners 108, 136 are inserted into box assemblies 110, 134, the locking elements will be biased to a locked position within ball locking groove 166. The locking elements 112, 132 in the locked position within ball locking groove 166 prevent vertical movement of box assemblies 110, 134 within outer barrel 104.

FIG. 10 shows the metal encased spring loaded seals 109, 111, 135, 137. The seals 109, 111, 135, 137 are located between the liners 108, 136 and the inner barrel 118. Liner 108 contains at least one seal cavity that positions seals 109, 111 on wear surface 120. Similarly, liner 136 contains at least one seal cavity that can be re-machined such that seals 135, 137 will be positioned on a different area of wear surface 126. Seals 109, 111, 135, 137 maintain pressure within the rotating head assembly and prevent well bore pressure from entering the rotating head assembly. Hydraulic fluid within the rotating head assembly maintains the pressure in the rotating head assembly. In addition, the hydraulic fluid found within the rotating assembly lubricates the bearing elements 116, 128.

The rotating head of the present invention alleviates a common problem realized in operating rotating heads in particular, which is the requirement of changing bearings, rubbers and effecting other maintenance to the internal parts of the rotating head. This problem is minimized in the rotating head of the present invention by simple operation of the box assembly to provide access to the internal parts From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A rotating head assembly apparatus through which a drill string may extend, the apparatus comprising:

an outer barrel having a passage through which the drill string may extend;

an inner barrel having a passage through which the drill string may extend, the inner barrel configured to pass into the outer barrel;

a box assembly having at least one locking aperture, the locking aperture configured to store at least one locking element, wherein at least a portion of the box assembly inserts between the inner barrel and the outer barrel;

the locking element stored within the locking aperture;

a liner configured to be inserted between the box assembly and the inner barrel wherein the liner biases the locking element into a locking aperture of the outer barrel to releasably attach the box assembly to the outer barrel, the liner maintaining the locking element in the locking aperture while the liner is inserted between the box assembly and the inner barrel.

2. The apparatus of claim 1, further comprising a wear surface attached to the inner barrel.

3. The apparatus of claim 2, wherein the wear surface is integrated with the inner barrel.

4. The apparatus of claim 3, wherein the wear surface is a tungsten sleeve.

5. The apparatus of claim 1, further comprising at least one top seal mounted between the inner barrel and the liner.

6. The apparatus of claim 5, wherein the top seal is a metal encased spring loaded seal.

7. The apparatus of claim 5 further comprising:

a seal cavity located on an interior section of the liner wherein the top seal is stored within the seal cavity, the seal cavity located adjacent the wear surface of the inner barrel.

8. The apparatus of claim 1, further comprising at least one bottom seal mounted between the inner barrel and the liner.

9. The apparatus of claim 8, wherein the bottom seal is a metal encased spring loaded seal.

10. The apparatus of claim 8 further comprising:

a seal cavity located on an interior section of the liner wherein the bottom seal is stored within the seal cavity, the seal cavity located adjacent the wear surface of the inner barrel.

11. The apparatus of claim 1 further comprising:

at least one die spring stored in the box assembly wherein the at least one die spring biases the bearing element.

12. A rotating head assembly apparatus having an outer barrel and an inner barrel having at least one bearing element positioned between the outer barrel and the inner barrel such that the inner barrel is mounted for rotation with respect to said outer barrel, the outer barrel having a locking aperture for attachment of a box assembly to the outer barrel, the apparatus comprising:

a box assembly that attaches to the outer barrel wherein the box assembly is configured to store at least one locking element;

a locking storage of the box assembly wherein the locking storage houses a locking element;

a locking element stored within the locking storage;

an exterior locking aperture located on an exterior wall of the box assembly, the exterior locking aperture located adjacent to the locking storage;

a liner configured to be inserted into the box assembly wherein the insertion of the liner into the box assembly biases the locking element outward partially through the exterior locking aperture to maintain the locking element at least partially through the exterior locking aperture to attach the box assembly to the outer barrel.

13. The apparatus of claim 12 wherein the locking element is a non-threaded locking element.

14. The apparatus of claim 12, further comprising:

a biasing aperture within the box assembly, wherein the biasing aperture is adapted to store a biasing element that loads a bearing element located adjacent to the box assembly.

15. The apparatus of claim 12, further comprising:

a seal cavity within the liner wherein the seal cavity is adapted to store a seal between the liner and a wear surface of the inner barrel.

16. The apparatus of claim 15, wherein the seal cavity places the seal in relation to a wear surface of the inner barrel.

17. The method of attaching a box assembly to the outer barrel of a rotating head assembly, the method comprising:

storing a locking element within a locking storage of the box assembly, the locking storage comprising an exterior locking aperture;

inserting a liner into the box assembly to bias the locking element outwardly at least partially through the exterior locking aperture of the locking storage; and biasing the locking element into a locking groove of the outer barrel to attach the box assembly to the outer barrel.

18. The method of claim 17 further comprising:

loading at least one bearing element with a die spring located within the box assembly.

19. The method of claim 17 further comprising:

sealing a box assembly with a seal stored in a seal cavity of the liner.

20. The method of claim 19 further comprising:

adjusting the placement of the seal against a wear surface by forming a new seal cavity on a different location of the liner to adjust the position of the seal cavity in relation to the wear surface.

* * * * *